United States Patent [19]

Okamoto et al.

[11] 4,035,183

[45] July 12, 1977

[54] METHOD FOR MAKING ALUMINUM-CONTAINING FERROALLOY

[75] Inventors: Kiyoshi Okamoto; Shizuo Kiriyama, both of Nagano; Ichiro Obayashi, Myokokogen; Kazuaki Yamamura, Myokokogen; Masaaki Senoo, Myokokogen, all of Japan

[73] Assignee: Chuo Denki Kogyo Co., Ltd., Japan

[21] Appl. No.: 605,722

[22] Filed: Aug. 18, 1975

[51] Int. Cl.[2] ..... C22C 33/04

[52] U.S. Cl. ..... 75/129; 75/134 M

[58] Field of Search ..... 75/129, 59, 134 M

[56] References Cited

U.S. PATENT DOCUMENTS

| | | | |
|---|---|---|---|
| 2,920,955 | 1/1960 | Goering | 75/129 |
| 3,545,960 | 12/1970 | McClellan | 75/59 |

*Primary Examiner*—Peter D. Rosenberg

[57] ABSTRACT

Disclosed is a method for aluminum-containing ferroalloy which comprises mixing 80 to 99 parts by weight of molten ferroalloy and 20 to 1 parts by weight of molten aluminum in a ladle.

1 Claim, No Drawings

METHOD FOR MAKING ALUMINUM-CONTAINING FERROALLOY

BACKGROUND OF THE INVENTION

This invention relates to a method for making an aluminum-containing ferroally, which is suitable for use as deoxidizer in manufacturing steel.

In a conventional method where aluminum is employed as a deoxidizer in manufacturing steel, aluminum is added to molten steel in a ladle. This method suffers, however, from the disadvantage that because the specific gravity of aluminum is lower than that of the molten steel, aluminum surfaces so that the efficiency of deoxidization is not only poor but is very inconsistent. In order to overcome this disadvantage, several methods have been practised, such as these in which aluminum shaped in the form of cannon balls is shot into the molten steel with, for example, compressed air, or, aluminum cased with a metal or metals having higher specific gravity is employed. These methods are, however, all disadvantageous in that they require numerous devices and employ complicated means for adding aluminum.

Recently, for the purpose of solving the problems stated above, additive alloys have been developed which, while being composed of silicomanganese or ferromanganese (substances conventionally added to steel for adjusting the composition thereof), additionally contain aluminum. Such additive aloys have higher specific gravities and work to increase deoxidization efficiencies.

There are two methods for making such additive alloys, one being the method where solid masses of aluminum are added to molten ferroally such as silicomanganese, ferromanganese or the like, the other being the method in which aluminum shots (small solid particles of aluminum) are mixed with powders or small particles of a ferroalloy and the mixture is subjected to pressure moulding with a suitable amount of binder to give it the form of briguettes.

The former method however is disadvantageous in that the aluminum surfaces because the specific gravity of the added aluminum is lower than that of the molten ferroalloy so that only an extremely small amount of aluminum is incorporated into the product alloys, a high degree of segregation of the aluminum occurs in the ferroalloy and the cost of manufacturing the product is increased.

The latter method also suffers from the disadvantage of high cost since briguetting requires equipment to carry out a number of processing steps including fragmentation and sizing of the aluminum and ferroalloy to make them suitable in size for briguetting, addition of binder, and pressure-molding with a pressure-molder.

Thus, although aluminum-containing ferroalloy is known to work as a deoxidizer of high efficiency and further to stabilize compositions of steels only by simple addition thereof to the steel, it has not received full practical application since it is difficult to make the same at low cost and with a high degree of homogenuity.

BRIEF SUMMARY OF THE INVENTION

It is therefore an object of the present invention to provide a method by which simple and homogeneous mixing of aluminum and ferroalloy, which have greatly differing specific gravities, can be accomplished.

The present invention is based on the discovery of the fact that, instead of adding solid masses of aluminum to molten ferroalloy as has been conventionally practized; the mixing of molten ferroalloy with molten aluminum will not only increase but also stabilize the amount of aluminum contained in the product in producing the aluminum-containing ferroalloy.

The present invention is further based on the discovery of the fact that by blowing of inert gas through the bottom of the ladle the mixing will be carried out more effectively.

DETAILED DESCRIPTION OF THE INVENTION

The present invention provides a method for making aluminum-containing ferroalloy which comprises in a ladle mixing 80 to b 99 parts by weight of molten ferroalloy and 20 to 1 parts by weight of molten aluminum.

The amounts of the molten metals, during the mixing in accordance with the present invention, are determined by the requirements that the temperature of molten aluminum is desired to be as low as possible, preferably below about 900° C, so that the aluminum is not likely to be oxidized, and that molten aluminum-containing ferroalloy resulting from the mixing in the ladle be at a temperature of about 1200° to 1350° C so that it has sufficient fluidity in being casted in a pig moulding machine.

This can be more clearly understood by a simple calorific calculation as follows in which silicomanganese of 14% Si is taken as an example. If the temperature of molten silicomanganese tapped from an electric furnace in 1350° C and that of molten aluminum is 850° C, the amounts thereof to be charged in the ladle for obtaining the temperature exceeding 1200° C of alloyed aluminum-containing silicomanganese obtained by the mixing in the ladle, can be extimated from the equation:

$$0.188 \times (100-a) \times (1350-1200) = 0.259 \times a \times (1200-850)$$

in which the values 0.188 and 0.250 are specific heats in terms of Cal./g.°C of silicomanganese and aluminum respectively, and $a$ represents the amount of the aluminum to be charged in terms of Kg. The solution of the equation gives $a = 237$ (kg). It is thus noted that an aluminum-containing silicomanganese product of an aluminum content of up to about 23% can be produced by carrying out the mixing of the molten silicomanganese and the molten aluminum in a short period of time.

According to the method of the present invention it is possible to manufacture aluminum-containing ferroalloy of an aluminum content of 1 to 20% as is evident from the above trial calculation. However, taking into consideration that in practical application the aluminum-containing ferroalloy is used as a deoxidizer in making steel to increase the content of aluminum incorporated in the steel, it is preferred that 1 to 10 parts by weight of the molten aluminum be mixed with 99 to 90 parts by weight of the molten ferroalloy so that the aluminum-containing ferroalloy obtained has sufficient high specific gravity. Among the ferroalloys practically used as deoxidizers in making steel in an aluminum-containing silicomanganese of an aluminum content of about 6 percent by weight.

The present invention further provides a method for making aluminum-containing ferroalloy in which the mixing is carried out along with blowing of inert gas into the ladle through the bottom of the ladle. The blowing of inert gas is accomplished with a gas-blowing device such as a porous plug provided at the bottom of the ladle so that the stirring in the ladle is effected with increased efficiency. The rate of blowing inert gas in preferably in the range of 1.0 to 2.0 $Nm^3$/min. per ton of aluminum-containing ferroalloy to be obtained.

Due to the stirring with inert gas, unalloyed aluminum surfacing in the molten metallic mixture is repeatedly sucked under by the body of the mixture thus resulting in advancement in the rate of aluminum incorporated into the ferroalloy as well as stabilization of aluminum content of the final product.

An insufficient rate of blowing inert gas will cause less stirring effect, while an excessive rate of blowing inert gas will tend to create undesired lowering of the temperature of the molten metals.

In mixing molten ferroalloy with molten aluminum according to the method of the present invention, the molten ferroalloy is charged into the ladle where the molten aluminum has previously been charged. Otherwise, the molten ferroalloy and the molten aluminum are simultaneously charged into the ladle. If the molten aluminum is poured into the ladle where the molten ferroalloy has previously been charged, the produced aluminum-containing ferroalloy is inconsistent in composition and has much lower content of aluminum incorporated therein, even if the mixing is carried out along with the blowing of inert gas.

The following table is given for general comparison of the method of the invention with the conventional method by showing the rate of incorporated aluminum, and the content and variation of aluminum contained in the products prepared by both methods. The term "the rate of incorporated aluminum" as used herein means the ratio of the quantity of aluminum contained in a product to that added to material ferroalloy.

TABLE 1

| Comparison of Method of Present Invention and Conventional Method | | | |
|---|---|---|---|
| Method | Rate of Incorporated Al (%) | Content of Al in Product (%) | Variation in Content of Al in Product (%) |
| (1) Conventional Method: Addition of Solid Masses of Aluminum to Molten Silicomanganese | 30 – 40 | 2 – 8 | ±60 |
| (2) Method of Present Invention: Mixing of Molten Aluminum and Silicomanganese with Stirring | 60 ± 3 | 4 – 6 | ±20 |
| (3) Method of Present Invention: Same as in (2) along with Blowing of Inert Gas through Bottom of Ladle | 80 ± 2 | 4.5 – 5.5 | ±10 |

The present invention will be understood more clearly with reference to the following examples. It should be noted however that these examples are intended to illustrate the invention and are not to be construed to limit the scope thereof.

EXAMPLE 1

Operation by the Conventional Method ( (1) of Table 1)

Composition of molten silicomanganese: Mn 60.5 – 62.0, Si 14.5 – 15.6%
Purity of aluminum: 97.1%
Desired content of aluminum in product: 5%

Small solid masses of aluminum were thrown into the ladle where molten silicomanganese had been charged (No. 1 and No. 2). Otherwise, molten silicomanganese was poured into the ladle in the bottom of which small solid masses of aluminum had been charged (No. 3 and No. 4). Then the mixture was casted continuously in a pig moulding machine and, after being cooled, was sized into desired sizes. The results are summarized in Table 2.

It must be added that in each of the examples herein described the aluminum content was determined for ten samples from the continuous pig moulding machine and the maximum and minimum values obtained are shown in the respective tables.

TABLE 2

| Operation by Conventional Method | | | | | |
|---|---|---|---|---|---|
| Run No. | | 1 | 2 | 3 | 4 |
| Weight of Silicomanganese | (Kg) | 4,950 | 5,040 | 4,870 | 4,930 |
| Weight of Aluminum | (Kg) | 450 | 660 | 460 | 660 |
| Composition of Product (%) | Mn | 58.3 | 57.6 | 58.8 | 56.1 |
| | Si | 14.5 | 14.4 | 13.8 | 14.0 |
| | Al | 3.5 | 5.3 | 3.5 | 5.2 |
| Weight of Product | (Kg) | 4,950 | 5,000 | 4,800 | 5,100 |
| Rate of Al Incorporated | (%) | 38.5 | 40.2 | 33.4 | 40.2 |
| Al Content of Product | (%) | 1.8–8.3 | 2.3–7.9 | 1.7–8.4 | 2.6–7.5 |

EXAMPLE 2

Operation by the Method of the Present Invention ( (2) of Table 1)

The same silicomanganese and aluminum were employed as in Example 1. The desired aluminum content of product was 5%. A determined amount of molten silicomanganse of a temperature of about 1350° C was poured with stirring into a ladle where a determined amount of aluminum melted by heating and of a temperature of about 850° C has been charged. The mixture was further stirred for about 10 minutes. Then the mixture of the molten metals of a temperature of about 1200° C was continuously casted in a pig moulding machine, and, after being cooled, was sized into desired sizes. The results are summarized in Table 3.

TABLE 3

| Operation by Method of Present Invention (2) | | | | |
|---|---|---|---|---|
| Run No. | | 5 | 6 | 7 |
| Weight of Silicomanganese | (Kg) | 4,930 | 5,270 | 5,010 |
| Weight of aluminum | (Kg) | 450 | 450 | 450 |
| Composition of Product | (%) | | | |
| | Mn | 57.4 | 58.7 | 58.1 |
| | Si | 13.7 | 14.2 | 14.2 |
| | Al | 5.1 | 5.2 | 5.1 |
| Weight of Product | (Kg) | 5,140 | 5,460 | 5,200 |
| Rate of Al Incorporated | (%) | 58.3 | 63.1 | 59.0 |
| Al Content of Product | (%) | 4.0–5.9 | 4.8–5.9 | 4.5–5.7 |

EXAMPLE 3

Operation by the Method of the Present Invention ( (3) of Table 1)

The same silicomanganese and aluminum were employed as in Example 1, and the aluminum content of product was desired to be 5.0%. In this example, a ladle was used which was equipped at the bottom with a porous plug for blowing inert gas into the ladle. The determined amounts of molten aluminum at about 850° C and molten silicomanganese at about 1350° C were poured into the ladle along with blowing of nitrogen gas through the porous plug at a flow rate of 6–8 $Nm^3$/sec, so that the metals were forcedly stirred by the action of the nitrogen gas. The mixture of about 1200° C was then casted in a pig moulding machine, followed by cooling and sizing into the desired sizes. The results are shown in Table 4.

TABLE 4

| Run No. | | Operation by Method of Present Invention (3) 8 | 9 | 10 |
|---|---|---|---|---|
| Weight of Silicomanganese | (Kg) | 4,610 | 4,850 | 4,790 |
| Weight of Aluminum | (Kg) | 280 | 300 | 300 |
| Composition of Product | (%) | | | |
| | Mn | 58.5 | 57.9 | 58.0 |
| | Si | 14.1 | 14.1 | 13.7 |
| | Al | 5.0 | 4.9 | 5.0 |
| Weight of Product | (Kg) | 4,620 | 4,950 | 4,760 |
| Rate of Al Incorporated | (%) | 82.5 | 80.9 | 79.5 |
| Al Content of Product | (%) | 4.9–5.4 | 4.8–5.3 | 4.9–5.3 |

EXAMPLE 4

Manufacture of aluminum-containing extra-low-carbon silicomanganese according to the method of the present invention

| | |
|---|---|
| Composition of the molten extra-low carbon silicomanganese: | |
| Mn | 50 – 55% |
| Si | 28 – 30% |
| C | up to 0.05% |
| Purity of aluminum: | 97.1% |

Molten aluminum was previously charged in a ladle equipped with a porous plug at the bottom thereof for blowing gas. The molten extra-low-carbon silicomanganese was poured into the ladle along with the blowing of nitrogen gas through the porous plug at a rate of 6 to 8 $Nm^3$/sec. The temperatures of the molten aluminum and the molten extra-low-carbon silicomanganese were about 850° and about 1700° C, respectively. The mixture was further stirred for about ten minutes, and then the resulting molten aluminum-containing extra-low-carbon silicomanganese was casted into a pig moulding machine, and after being cooled, was crushed and sized into desired sizes. The results are summarized in Table 5.

TABLE 5

| Run No. | | Manufacture of aluminum-containing extra-low-carbon silicomanganese according to present invention 11 | 12 |
|---|---|---|---|
| Weight of extra-low-carbon silicomanganese | (Kg) | 4,950 | 5,030 |
| Weight of aluminum | (Kg) | 720 | 720 |
| Composition of Product | (%) | | |
| | Mn | 49.2 | 49.4 |
| | Si | 26.8 | 26.9 |
| | Al | 10.5 | 10.2 |
| | C | <0.05 | <0.05 |
| Weight of Product | (Kg) | 4,850 | 4,930 |
| Rate of Al Incorporated | (%) | 81.0 | 80.0 |
| Al Content of Product | (%) | 9.8–10.3 | 9.8–10.3 |

It is clearly seen from the above that in the manufacture of aluminum-containing ferroalloy the present invention provides remarkable advantages in improving the rate of aluminum incorporated into the steel and reducing the variation in the content of aluminum in the products.

While the present invention has been described mainly in connection with the method for preparing aluminum-containing silicomanganese, the present invention is not limited thereto but provides a method for preparing other aluminum-containing ferroalloys such as ferrosilicon, middle- or low-carbon ferromanganese and the like which are suitable for use as deoxidizer in making steel.

What we claim is:

1. A method of preparing a deoxidizer for steel, said deoxidizer consisting of an aluminum-containing silicomanganese ferroalloy wherein the amount of aluminum is from 1 to about 6% by weight and having an improved homogeneity of aluminum in said ferroalloy which process comprises charging molten ferroalloy and molten aluminum simultaneously into a ladle and blowing an inert gas through said charge from the bottom of the ladle.

* * * * *